US008668110B1

(12) United States Patent
Traxler et al.

(10) Patent No.: US 8,668,110 B1
(45) Date of Patent: Mar. 11, 2014

(54) VENTING MECHANISMS FOR CONTAINERS

(71) Applicant: Cornerstone Research Group, Inc., Dayton, OH (US)

(72) Inventors: Eric W. Traxler, Beavercreek, OH (US); Jamie B. Vanderhorst, West Chester, OH (US); David E. Havens, Bellbrook, OH (US); Brandon C. Kirby, Beavercreek, OH (US); Michael J. Fisher, Springboro, OH (US); Joel J. Everhart, Beavercreek, OH (US); Matthew C. Everhart, Fairborn, OH (US)

(73) Assignee: Cornerstone Research Group, Inc., Dayton, OH (US)

( * ) Notice: Subject to any disclaimer, the term of this patent is extended or adjusted under 35 U.S.C. 154(b) by 0 days.

(21) Appl. No.: 13/718,361

(22) Filed: Dec. 18, 2012

Related U.S. Application Data

(63) Continuation of application No. 12/526,360, filed as application No. PCT/US2008/056031 on Mar. 6, 2008, now Pat. No. 8,356,727.

(60) Provisional application No. 60/893,499, filed on Mar. 7, 2007.

(51) Int. Cl.
*B65D 6/40* (2006.01)

(52) U.S. Cl.
USPC ..... 220/745; 220/202; 429/53; 429/56

(58) Field of Classification Search
USPC ..... 220/202, 745; 429/53, 56
See application file for complete search history.

(56) References Cited

U.S. PATENT DOCUMENTS

| | | | |
|---|---|---|---|
| 4,430,392 | A | 2/1984 | Kelley et al. |
| 5,804,073 | A | 9/1998 | Ter Horst |
| 5,829,979 | A | 11/1998 | Kobashigawa et al. |
| 6,321,656 | B1 | 11/2001 | Johnson |
| 6,338,242 | B1 | 1/2002 | Kim et al. |
| 6,360,526 | B2 | 3/2002 | Kunstmann |

(Continued)

FOREIGN PATENT DOCUMENTS

| | | | |
|---|---|---|---|
| WO | 2005108448 | A1 | 11/2005 |
| WO | 2005116573 | A1 | 12/2005 |
| WO | 2007070877 | A2 | 6/2007 |

OTHER PUBLICATIONS

International Search Report for Application No. PCT/US2008/56031 dated Sep. 10, 2008.

(Continued)

*Primary Examiner* — Anthony Stashick
*Assistant Examiner* — Elizabeth Volz
(74) *Attorney, Agent, or Firm* — Dinsmore & Shohl LLP

(57) ABSTRACT

The disclosed device primarily consists of a band, ring, or other piece of shape memory polymer (SMP) or SMP composite in various embodiments that allows or disallows containment. When the SMP reaches its transition temperature (Tg) the SMP provides the means for releasing containment of the pressurized material so as to prevent ignition or explosion of hazardous material. At normal operating temperatures, the SMP is in a deformed shape maintaining an environmental seal to protect the contents of the container. When environmental conditions cause the SMP or SMP composite to exceed its Tg, specified by the operating requirements, the SMP returns to its memory shape in a controlled geometry, rather than simply melting. The return of the SMP to its memory shape causes the venting of the container in different manners depending on which embodiment is utilized.

8 Claims, 11 Drawing Sheets

(56) References Cited

U.S. PATENT DOCUMENTS

| | | | |
|---|---|---|---|
| 6,363,855 | B1 | 4/2002 | Kim et al. |
| 6,759,481 | B2 | 7/2004 | Tong |
| 7,373,885 | B2 | 5/2008 | Skinner |
| 2001/0035005 | A1 | 11/2001 | Kunstmann |
| 2004/0244358 | A1 | 12/2004 | Prytz |
| 2005/0199055 | A1 | 9/2005 | Browne |
| 2006/0207460 | A1 | 9/2006 | Reed |
| 2006/0243153 | A1 | 11/2006 | Skinner et al. |
| 2006/0254452 | A1 | 11/2006 | Hunn et al. |
| 2007/0095239 | A1 | 5/2007 | Skinner |
| 2007/0240600 | A1 | 10/2007 | Skinner et al. |
| 2007/0265710 | A1 | 11/2007 | Brown et al. |

OTHER PUBLICATIONS

International Preliminary Report on Patentability for Application No. PCT/US2008/56031 dated Sep. 8, 2009.

VENTING MECHANISMS FOR CONTAINERS

CROSS REFERENCE TO RELATED APPLICATIONS

This application is filed as a continuation of U.S. application Ser. No. 12/526,360 filed on Aug. 7, 2009, which is a national stage entry of PCT/US2008/56031 filed on Mar. 6, 2008, which claims priority to U.S. Provisional Application Ser. No. 60/893,499 filed on Mar. 7, 2007.

GOVERNMENT RIGHTS

This invention was made with U.S. Government support under Contract No. W9113M-06-C-0078 and Contract No. HQ0006-07-C-7609 awarded by the U.S. Army Space & Missile Defense Command to Cornerstone Research Group Inc. The U.S. Government has certain rights in the invention.

TECHNICAL FIELD OF THE INVENTION

Under normal operating conditions, most containment devices are both effective and relatively safe. These containment devices provide an essential function in storing items and preventing the unwanted spread of the various materials stored in them. These containment devices are especially useful in preventing environmental contamination of explosive or hazardous material. In particular these containment devices are used in modern munitions. In munitions, containment devices provide an essential military capability and are unlikely to explode or burn spontaneously, despite the fact that they are composed primarily of hazardous material.

However, when munitions, such as solid rocket motors (SRMs), are placed under unwanted stimuli, like heat and mechanical shock, dangerous results can occur. SRMs may be triggered to ignition by fire or by impact with bullets or fragments. As a result there is a push to develop a class of SRMs that are insensitive munitions (IM). An IM is one that will not detonate under any conditions other than its intended mission. If an IM is struck by fragments from an explosion or hit by a bullet, it will not detonate. Additionally, IMs will not detonate if it is in close proximity to a target that is hit. In extreme temperatures, the SRMs will only burn (without detonation or explosion). This increased safety allows greater numbers of missiles to be packaged, handled, stored, and transported in smaller containers. These requirements demand higher levels of safety performance: the system will be safer to operate in any environment while maintaining its lethal performance. It also allows for cost saving opportunities for the government because more SRM will be able to be stored in a smaller area, safely.

As a result of a number of well publicized accidents in recent years involving premature and inadvertent activation of munitions with resultant loss of life among service personnel as well as other damage, there has been an increased emphasis on creating IM which are safer to store, handle and use. Specifically, in October 2006, in Baghdad, Iraq, a fire erupted in a U.S. ammo dump, setting off a series of blasts due to the detonation of the ammunition being stored in the facility. This is a prime example of the need for current and future munitions to be IM compliant.

As new SRM systems are developed, they will be required to meet a growing set of specifications for IM compliance. The current technologies that are used to minimize the effects of unintentional stimuli on SRMs are insufficient and new IM technologies must be developed to allow IM compliance in future systems. One of the first lines of defense in protection of the SRM is the containers that these munitions are stored in during inactive periods. These containers can protect the SRM from bullet fragments and can serve as a containment system in slow and fast cook-off situations. However, during slow and fast cook-offs of the SRM, the container must be capable of sufficiently venting the generated gasses. Current containers are sealed to protect the ammunition from the outside environment; however, to reach IM compliance, containers must be capable of venting when a set of predetermined conditions are met. SRM cases can also be vented to allow for IM-compliant systems. Additionally, the disclosed device can be used to prevent over-pressurization of volatile liquid and other hazardous containers to prevent similar explosions and loss of life.

BACKGROUND ART

Based on recent incidents with the unintentional detonation of munitions, there has been increased research into the area of creating better, more efficient IM. Most of these newer systems rely on passively activated designs to vent their explosive material to the environment before environmental conditions can activate the propellants or munitions.

Some systems that have been developed use explosive products to create holes in the munitions or propellant containers to vent them. The explosive products or the impact of a bullet, fragment, or shaped charge jet from the systems may result in a temperature sufficient to ignite the propellants or munitions. Additionally the explosive products or the impact of a bullet, fragment, or shaped charge jet may inadvertently initiate the venting system thereby rendering the munitions ineffective.

In U.S. Pat. No. 6,360,526 issued to Kunstmann on Mar. 26, 2002 such an passive system is described. A rocket motor having a desensitizing mechanism for preventing explosion or violent reaction during slow cook off is disclosed. In Kunstmann the rocket motor includes a case contained rocket propellant with a desensitizing assembly attached forward of the propellant charge. The desensitizing assembly is formed with an enclosure containing a desensitizing fluid, and connected to the interior of the rocket motor by a tube which is sealed by a heat sensitive plug. The heat sensitive plug melts at a temperature below the slow cook off temperature of the rocket propellant and the melting of the plug allows the desensitizing fluid to be injected into the interior of the casing and onto the propellant charges, thereby, desensitizing the propellant charge.

In U.S. Pat. No. 6,338,242 issued to Kim et. al on Jan. 15, 2002 a similar passive system is disclosed. In Kim, an ordnance venting system has an ordnance device having a casing with a vent opening, a dome plug fitted into the formed vent opening and an adapter fitted over the dome plug on the outside of the casing. The adapter connects sufficiently to the casing to retain the dome plug against the formed vent opening for given pressures. The adapter melts at high temperatures and releases the dome plug to reduce the danger of explosion from heat induced over pressurization.

One system utilizing a charge is described in U.S. patent application Ser. No. 11/261,184 filed Oct. 28, 2005 by Skinner. Skinner discloses a device for venting a container housing and energetic material including an installation portion, a charge holder disposed in the insulating portion, and an explosive cutting charge disposed in the cardholder. The device further includes a thermally activated initiation device, and a transfer line coupling the thermally activated initiation device and the explosive cutting charge. When exposed to a temperature at or above a predetermined temperature heat produced deflagration of the thermally activated initiation device initiates deflagration in the transfer line which in turn detonates explosive cutting charges. Upon detonation these explosive cutting charges perforate the container to relieve pressure or avoid buildup of pressure within the case.

Fuses, charges or plugs do allow venting however they are not as durable and they do not allow as easily for normal operation as the presently disclosed device. They also do not offer a lot of venting; therefore many plugs, fuses or charges may be required.

For the purposes of this application the term Shape Memory Polymers as described below is equivalent to Dynamic Modulus Resins.

Shape memory materials were first developed about 20 years ago and have been the subject of commercial development in the last 10 years. Shape memory materials derive their name from their inherent ability to return to their original "memorized" shape after undergoing a shape deformation. There are principally two types of shape memory materials, shape memory alloys (SMAs) and shape memory polymers (SMPs).

SMAs and SMPs that have been preformed can be more easily deformed to a desired shape above their glass transition temperature (Tg). The SMA and SMP must remain below, or be quenched to below, the Tg while maintained in the desired shape to "lock" in the deformation. Once the deformation is locked in, the SMA, because of its crystalline network, and the SMP, because of its polymer network, cannot return to a relaxed state due to thermal barriers. The SMA and SMP will hold its deformed shape indefinitely until it is heated above its Tg, whereupon the SMA and SMP stored mechanical strain is released and the SMA and SMP returns to its preformed state.

There are principally two types of plastics, thermoset resins and thermoplastic resins, each with its own set of unique characteristics. Thermoset resins, for example polyesters, are liquids that react with a catalyst to form a solid, and cannot be returned to their liquid state, and therefore, cannot be reshaped without destroying the polymer networks. Thermoplastics resins, for example PVC, are also liquids that become solids. But unlike thermoset resins, thermoplastics are softened by application of heat or other catalysts. Thermoplastics can be heated, reshaped, heated, and reshaped over and over.

SMPs used in the presently disclosed device are unique thermosetting polymers that, unlike traditional thermosetting polymers, can be reshaped and formed to a great extent because of their shape memory nature and will not return to a liquid upon application of heat. Thus by creating a shape memory polymer that is also a thermosetting polymer, designers can utilize the beneficial properties of both thermosetting and thermoplastic resins while eliminating or reducing the unwanted properties. Such polymers are described in U.S. Pat. No. 6,759,481 issued to Tong, on Jul. 6, 2004 which is incorporated herein by reference. Other thermoset resins are seen in PCT Application No. PCT/US2006/062179, filed by Tong, et al on Dec. 15, 2006; and PCT Application No. PCT/US2005/015685 filed by Tong et al, on May 5, 2005 of which both applications are incorporated herein by reference.

There are three types of SMP's: 1) A partially cured resin, 2) thermoplastics, and 3) fully cured thermoset systems. There are limitations and drawbacks to the first two types of SMP. Partially cured resins continue to cure during operation and change properties with every cycle. Thermoplastic SMP "creeps," which mean it gradually "forgets" its memory shape over time. A thorough understanding of the chemical mechanisms involved will allow those of skill in the art to tailor the formulations of SMP to meet specific needs, although generally fully cured thermoset resin systems are preferred in manufacturing.

While SMA and SMP appear to operate similarly on the macro scale, at the molecular scale it is apparent that the method of operation of each is very different. The difference between SMA and SMP at the molecular level is in the linkages between molecules. SMA essentially has fixed length linkages that exist at alternating angles establishing in a zigzag patterned molecular structure. Reshaping is achieved by straightening the angled connections from alternating angles to straight forming a cubic like structure. This method of reshaping SMA material enables bending while limiting any local strains within the SMA materials to less than 8% strain, as the maximum shape memory strain for SMA is 8%. This 8% strain allows for the expansion or contraction of the SMA by only 8%, a strain that is not useful for most industrial applications. Recovery to memory shape is achieved by heating the material above a certain temperature at which point the molecules return to their original zigzag molecular configuration with significant force thereby reestablishing the memory shape. The molecular change in SMA is considered a metallic phase change from Austensite to Martensite which is defined by the two different molecular structures.

SMP has connections between molecules with some slack. When heated these links between connections are easily contorted, stretched and reoriented due to their elastic nature as the SMP behaves like an elastic material when heated, when cooled, the shape is fixed to how it was being held. In the cooled state the material behaves as a typical rigid polymer that was manufactured in that shape. Once heated the material again returns to the elastic state and can be reformed or return to the memory shape with very low force. Unlike SMA which possesses two different molecular structures, SMP is either a soft elastomer when heated or a rigid polymer when cool. Both SMA and SMP can be formulated to adjust the activation temperature for various applications. Critical to the success of the currently claimed device is thermoset SMP which provides an order of magnitude higher stiffness than previous state-of-the-art thermoplastic SMPs. This added stiffness coupled with high strain capability enables the development and use of a highly useful composite tooling technology.

Shape memory alloys have been used to attempt to solve the IM issue as disclosed in U.S. Pat. No. 6,321,656 issued to Johnson on Nov. 27, 2001. In Johnson a thermally responsive material, such as Nitinol, an SMA, is used to create a latching mechanism which, upon exposure to temperatures in excess of the Tg of the Nitinol, the latching mechanism changes shape so as to mechanically unlatch the rocket casing section holding the propellant. However, as noted above the shape change is minimal requiring very large mechanisms to ensure unlatching or thinner SMA as the latching mechanism which may fail due to a lack of structural strength. Additionally Johnson does not describe or disclose the use of an SMP or SMP composite for use in a venting system for IM.

The term "composite" is commonly used in industry to identify components produced by impregnating a fibrous material with a thermoplastic or thermosetting resin to form laminates or layers. Generally, polymers and polymer composites have the advantages of weight saving, high specific mechanical properties, and good corrosion resistance, which make them indispensable materials in all areas of manufacturing. Nevertheless, manufacturing costs are sometimes detrimental, since they can represent a considerable part of the total costs and are made even more costly by the inability to quickly and easily repair these materials without requiring a complete, and expensive, total replacement. Furthermore, the production of complex shaped parts is still a challenge for the composites industry. Because SMPs are resins, they can be used to make composites, which are referred to in this application as SMP composites.

Unlike SMAs, SMPs exhibit a radical change from a normal rigid polymer to a flexible elastic and back on command. SMA would be more difficult to use for thermally activated venting systems for rocket motors because SMAs do not have the ease in changing the activation temperature as do SMP's for different propellants. SMAs would also have issues with galvanic reactions with other metals which would lead to long term instability. The current supply chain for SMAs is currently not consistent as well. SMP materials offer the stability and availability of a plastic and are more inert than SMAs. Additionally, when made into a composite SMPs offer similar if not identical mechanical properties to that of traditional metals and SMAs in particular. Throughout this disclosure SMP and SMP composites are used interchangeably as each can be replaced by the other depending on the specific design requirements to be met.

Therefore there is a need for a low cost, high strain system to allow for the easy venting of IM so as to prevent inadvertent or slow cook off of stored munitions.

DISCLOSURE OF THE INVENTION

The presently disclosed application provides a method and means for ensuring that containers of all types and sizes are vented or purged to atmospheric or environmental conditions upon the exterior of the container reaching a critical temperature. The preferred embodiment of this application is in allowing pressurized fuel containers to vent to the atmosphere before the fuel reaches temperatures which would cause it to explode. More preferably the presently disclosed device is used in munitions stored for long periods of time.

The most preferred embodiment of the disclosed device primarily consists of a band, ring, or other piece of shape memory polymer (SMP) or SMP composite in various embodiments that allow or disallow containment. When the SMP reaches its transition temperature (Tg) the SMP provides the means for releasing containment of the pressurized material so as to prevent ignition or explosion of hazardous material. At normal operating temperatures, the SMP is in a deformed shape maintaining an environmental seal to protect the contents of the container. When environmental conditions cause the SMP or SMP composite to exceed its Tg, specified by the operating requirements, the SMP returns to its memory shape in a controlled geometry, rather than simply melting. The return of the SMP to its memory shape causes the venting of the container in different manners depending on which embodiment is utilized.

MODES FOR CARRYING OUT THE INVENTION

The disclosed device primarily consists of a band, ring, or other piece of shape memory polymer (SMP) or SMP composite in various embodiments that allows or disallows containment. When the SMP reaches its transition temperature (Tg) the SMP provides the means for releasing containment, typically through the release of an air-tight seal, of the pressurized material so as to prevent ignition or explosion of hazardous material. At normal operating temperatures, the SMP is in a deformed shape maintaining an environmental seal to protect the contents of the container. When environmental conditions cause the SMP or SMP composite to exceed its Tg, specified by the operating requirements, the SMP returns to its memory shape in a controlled geometry, rather than simply melting. The return of the SMP to its memory shape causes the venting of the container in different manners depending on which embodiment is utilized.

SMP combined with traditional composite materials offer high strength to weight ratios, similar to other composites. However, SMP composites offer a unique ability to release stored mechanical energy at a predetermined temperature range. This unique set of mechanical properties makes SMPs ideal for implementing IM-compliant lightweight hybrid-composite ammunition containers. The disclosed device and designs show various embodiments of an optimized pressure venting mechanism that utilizes SMP's properties for actuation.

The design of the SMP part to be used in the disclosed mechanism will be apparent to those of skill in the art of creating such parts and will vary greatly from container to container depending on which embodiment of the disclosed device is utilized. However, the formulations and chemical makeup of the SMP to be used will vary greatly depending on such factors as normal environmental conditions the mechanism will be exposed to, costs, desired activation temperature or other activation conditions, and the strength of the material needed. As noted above, SMPs can be created to meet the operating specifications needed for various situations. The Tg of SMPs can be tailored such that the Tg of the SMP occurs between 0° Celsius and 280° Celsius. The SMP to be used can be selected from the group consisting of styrene based, epoxy based, cyanate ester based, polyurethane based, siloxane based, or other chemicals which can be made into an SMP. Additionally, while thermal activation of the SMP is the preferred method, there are other methods besides thermal energy to transition the SMP between its hard rigid state to a soft pliable and elastic state and back. Electromagnetic radiation, UV light, water, and magnetism can be used to transition the SMP between its hard rigid state to a soft pliable and elastic state and back.

Figure 13:
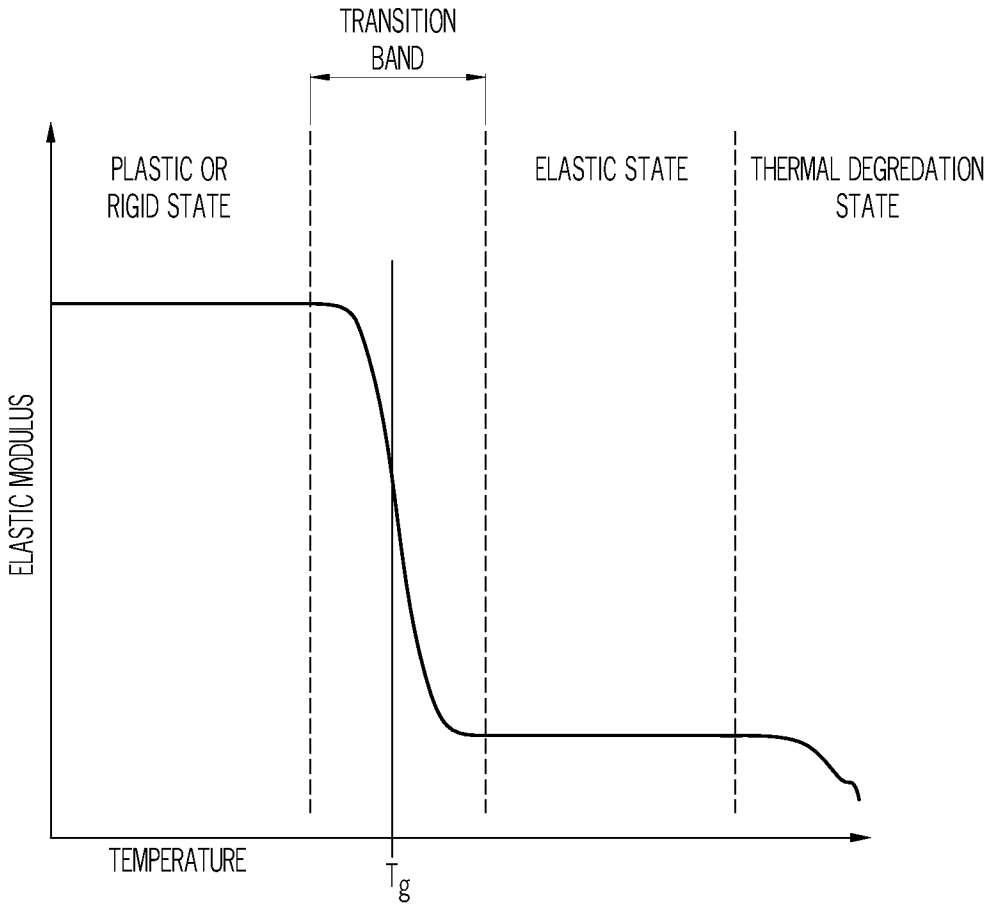
FIG. 13 is a graph showing the relationship of the elastic modulus of shape memory polymer versus the temperature of the shape memory polymer.

FIG. 13 is a graph showing the unique properties of SMP. The graph in FIG. 13 is a plot of the elastic modulus of a typical SMP versus the temperature of that SMP. In the first band, the Plastic or Rigid State, the SMP has all the strength of a traditional plastic. In the third band, the Elastic State, the SMP behaves like a heated thermoset resin which is pliable and soft. In the fourth state, the Thermal Degradation State, the SMP decomposes and loses its structural integrity. However, the temperatures of the Thermal Degradation State are typically well above 500° C., well above the temperatures needed for use in industry. The second band, Transition Band, is the area where the SMP transitions from a hard, rigid state to a soft, pliable state. The Tg is exactly in the middle of this band. The size of the band can be tailored such that the temperature range of the band is 5-10 degrees Celsius.

SMP composites can use a variety of fibrous material such as carbon nano-fibers, carbon fiber, spandex, chopped fiber, random fiber mat, fabric of any material, continuous fiber, fiberglass, or other type of textile fabric compatible with the SMP resin. Additionally, the strength of the SMP composite can be influenced by the weave of the fabric such as a flat weave, two dimensional weave, or three dimensional weave patterns. The SMP composites may comprise a composite material formed from at least one layer of fibrous material in combination with a shape memory polymer. In one form, the fibrous material may be embedded within the shape memory polymer or, the fibrous material can be impregnated with the shape memory polymer.

The following examples provide formulations of SMP which can be used in the currently disclosed device. However, these examples should not be interpreted as limiting the scope of this application to only those formulations provided.

Example 1

A polymeric reaction mixture was formulated by mixing vinyl neodecanoate (7%), divinyl benzene (1%), and styrene (90%) in random order to yield a clear solution. Benzoyl peroxide (2%) was then added to the resulting solution (all composition % are by weight). The resulting solution was kept cold in a refrigerator before use.

Example 2

A polymeric reaction mixture was formulated by mixing vinyl neodecanoate (7%), divinyl benzene (1%), and styrene (60%) in random order to form a colorless solution. Polystyrene granules (30%) were then added to the resulting solution. The resulting mixture was then allowed to sit at room temperature with occasional stirring until all the polystyrene granules were dissolved to give a clear, viscous solution. Benzoyl peroxide (2%) was then added to the resulting solution (all composition % are by weight). The resulting mixture was ultrasonicated at room temperature for 15 minutes to yield a clear solution. The resulting solution was kept cold in a refrigerator before use.

Example 3

As an example, 1.08 g aniline (amine reagent) was mixed with 0.066 g of methylenedianline (crosslinking diamine). The resulting solution was mixed with 4.17 g of bisphenol A diglycidyl ether to form an homogeneous solution.

Example 4

For a resin system with a Tg of 1030 C, Bisphenol A diglycidyl ether at 78.94% weight is mixed with aniline at 19.88% weight and DETDA (major isomers: 3,5-diethyltoluene-2,4-diamine and 3,5-diethyltoluene-2,6-diamine) at 1.19% weight.

Example 5

For a resin system with a Tg of 600 C, diglycidyl ether of Bisphenol A at 45.32% weight and 1,4-butanediol diglycidyl ether at 31.38% weight are mixed with aniline at 21.99%-weight and DETDA (major isomers: 3,5-diethyltoluene-2,4-diamine and 3,5-diethyltoluene-2,6-diamine) at 1.31% weight. All components are miscible liquids and are easily combined through mechanical mixing.

To prepare the SMP for use in an IM device, the reaction mixtures formulated above are injected into a mold fabricated into the shape of the SMP ring to be used in the IM device. The SMP and mold is then heated in an oven maintained at atmospheric pressure and a temperature of 75° C. for 24 hours to cure the SMP. After the SMP is cured it is removed from the oven and immediately transferred to a warm water bath. The temperature of water used was about 60° C. The SMP is demolded under the warm water by applying a slight prying force at the edges of the mold. The SMP ring is then allowed to dry and cool down to room temperature, resulting in a ring of SMP to be used in the IM device. Of the above examples, Example 3 is particularly preferred for use in the disclosed device.

In addition to using pure resin as the mechanism for the venting of a container, the SMP resin can be combined with fibers to create a composite. This is accomplished by curing the resin, in the mold, with the fibers within the resin matrix. Alternatively, a filament winding system or other composite manufacturing process can be used Any type of SMP with a sufficiently tailorable and narrow transition band could be used based on the requirements of the actual Tg needed. Some SMPs which can be used are styrene based, epoxy based, cyanate ester based, polyurethane based, or siloxane based SMPs. Of the above, epoxy based SMPs are particularly preferred for their ease of use, manufacture, and low environmental danger posed.

Figure 1A:
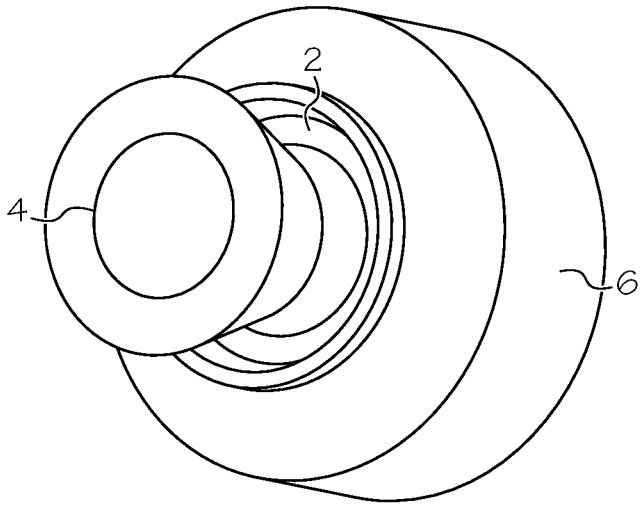
FIG. 1A shows a perspective view of one embodiment of an IM compliant mechanism.
Figure 1B:
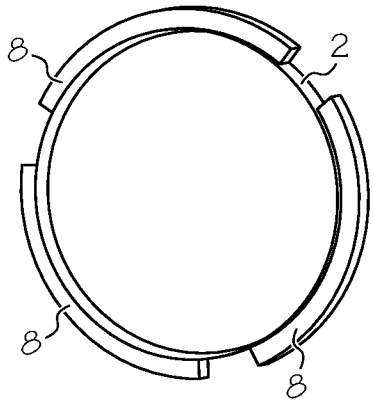
FIG. 1B shows the shape memory polymer ring and metal latches used in the first embodiment of the IM compliant mechanism.

FIG. 1A shows one embodiment that is a simplified mechanism that is a failsafe SMP-actuated pressure venting system that provides IM compliance. The SMP or SMP composite band, 2, depicted in FIG. 1A, vents pressure when a specific threshold temperature is reached and the end section, 4, is able to detach from the main body, 6. The mechanism, as shown in FIG. 1B, primarily consists of a ring or band of SMP or SMP composite band, 2, attached to metal latches, 8, that allows or disallow containment.

Figure 2A:
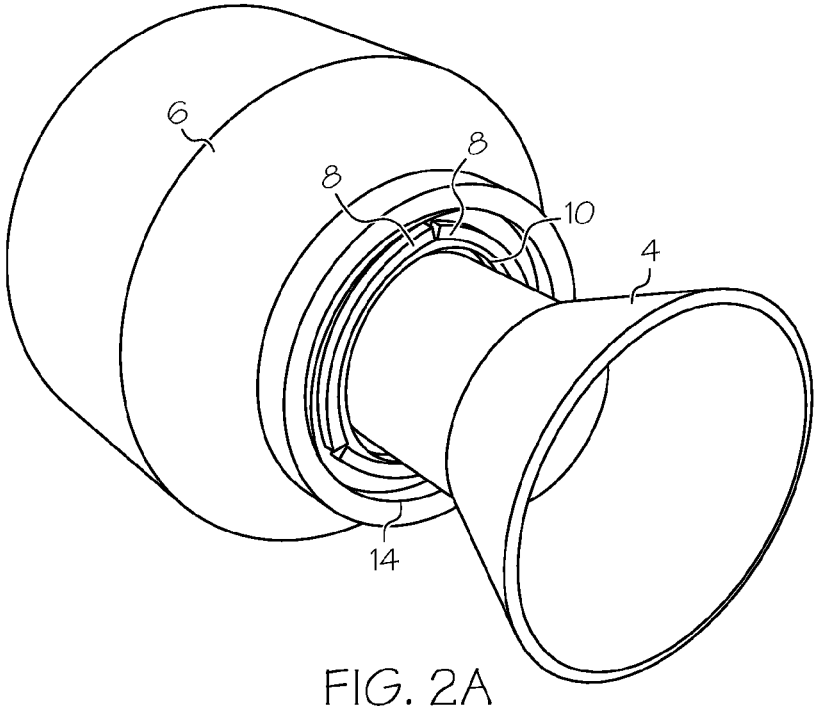
FIG. 2A shows a perspective view of the first embodiment with the SMP ring partially retracted from the IM.
Figure 2B:
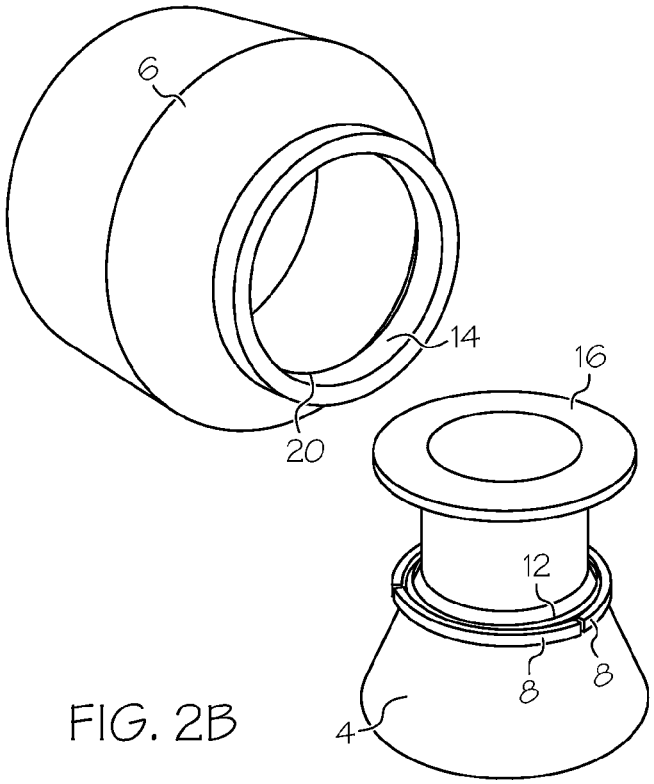
FIG. 2B shows the fully retracted SMP ring which has caused the two parts to the IM compliant mechanism to become separated.

As seen in FIG. 2A, when the SMP or SMP composite band, 10, reaches its transition temperature (Tg) the SMP returns to its memory shape which is smaller than its deformed shape and this provides the means for releasing containment of the pressurized material so as to prevent ignition or explosion of hazardous material by retracting the metal latches, 8. At normal operating temperatures, the tension of the SMP or SMP composite band keeps the metal latches of the mechanism in contact with the lip, 14, of the body of the main body 6, maintaining an environmental seal to protect the contents. In case of fire, or other condition, wherein the SMP exceeds its Tg specified by the operating requirements, the band actuates in a controlled geometry, rather than simply melting. As shown in FIG. 2B, the return of the SMP or SMP composite band, 12, to its memory shape causes the metal latches, 8, to retract from the lip, 14, of the main body, 6, and unseal the end section, 4, from the body of the container, thereby venting the container. The main body, 6, has a hole, 20, through which the end section, 4, has a second lip, 16, wherein the second lip, 16, has a diameter slightly less than the diameter of the hole, 20. The ring shown in FIG. 1B is used to ensure the seal between the end section, 4, and main body, 6.

Metal is the primary structural element in this embodiment, with the SMP or SMP composites used to keep the metal latches, 8, in contact with the main body, 6, throughout normal operation. In this embodiment, if the SMP is damaged, the pressure is released. In other words, the mechanism is not reliant on the SMP to apply a force for activation, but directly the converse.

One of the major benefits in this embodiment is the fact that the SMP does not bear a lot of load. The three metal latches, 8, fits into a groove between the lip, 14, and second lip, 16, that holds the end section, 4, in place with the enlarged SMP or SMP composite band, 2. Another advantage of this embodiment using SMP is the ability to tailor the activation temperature to enable the use of the mechanism with a variety of propellants. A rocket motor manufacturer can specify a propellant, and a manufacturer can determine an SMP formulation to meet the transition temperature requirements.

Figure 3A:
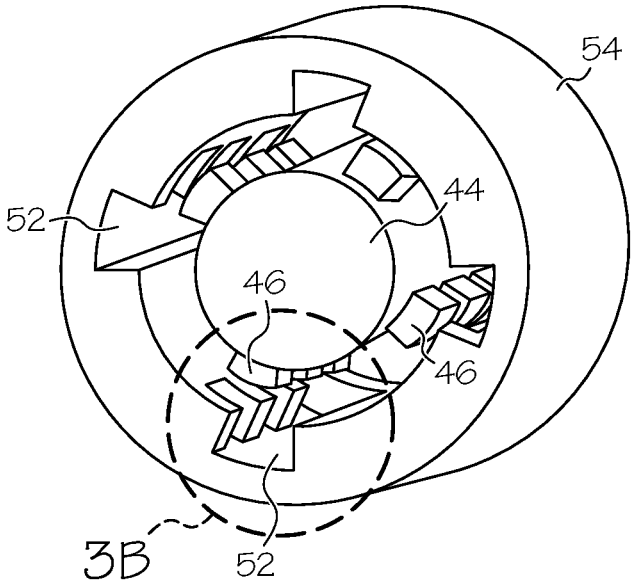
FIG. 3A shows a perspective view of a second embodiment of the venting mechanism.
Figure 3B:
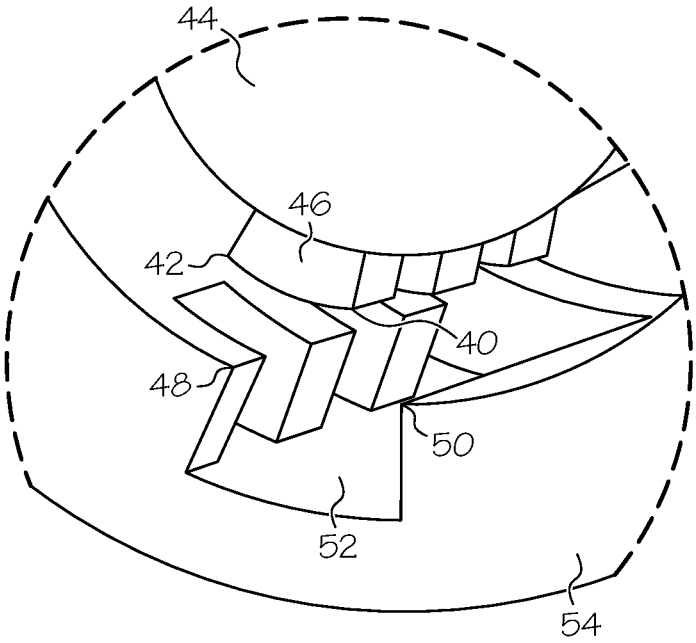
FIG. 3B shows a close up of how the latches for the second embodiment of the venting system can be used to latch onto a container.

FIGS. 3A and 3B show a second embodiment. In FIG. 3A a piece of SMP or SMP composite, 44, is constructed in a geometric shape consistent with that of the outer part, 54, to hold in place such that the SMP or SMP composite, 44, can fit within the outer part, 54. The SMP or SMP composite, 44, has additional SMP or SMP composite tabs, 46, which are initially smaller than similarly shaped holes, 52, in the outer part 54. In FIG. 3B, it can be seen that the SMP or SMP composite tabs, 46, have a distance between one side point, 42, and a second side point, 40, wherein this distance is smaller than the distance between a third side point, 48, and a fourth side point, 50, of a hole, 52, such that the SMP or SMP composite tabs, 46, can be inserted into hole, 52.

Figure 4A:
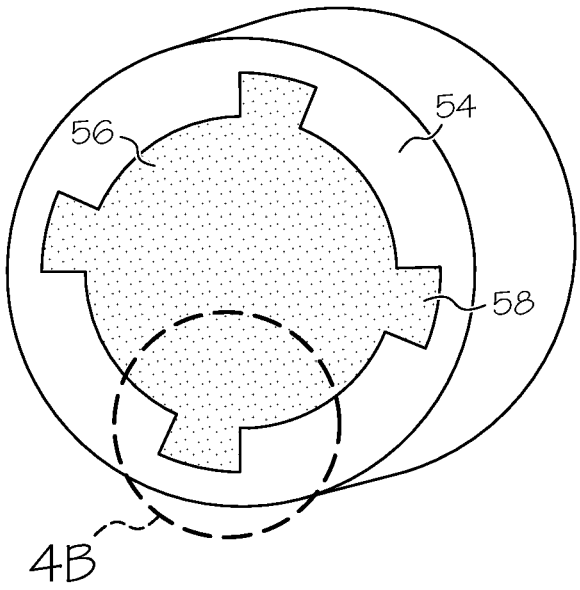
FIG. 4A shows a perspective view of the second embodiment of the venting system sealing a container.
Figure 4B:
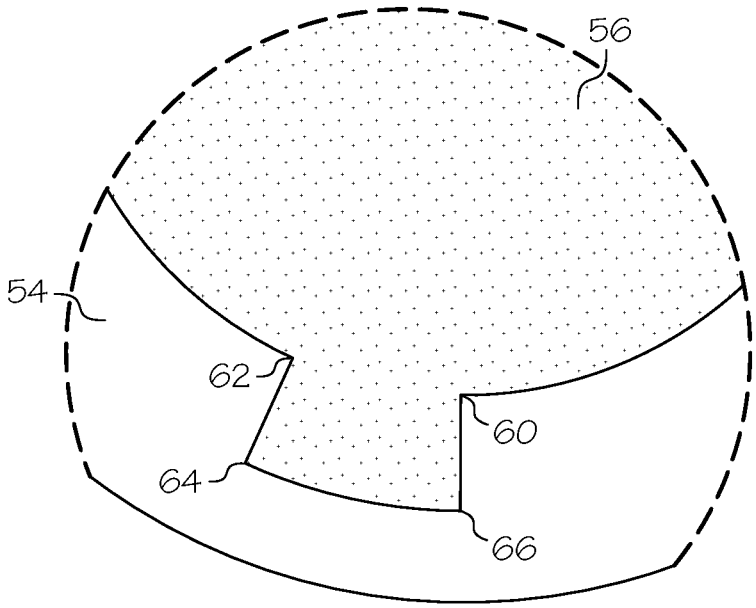
FIG. 4B shows a close up of how the latches for the second embodiment of the venting system actually latch onto the side of the container.

The SMP or SMP composite, 44, once inside the outer part, 54, can be expanded either by activating and deforming the SMP or SMP composite or by activating the SMP or SMP composite and allowing it to return to its memory shape which shape shown in FIG. 4A, 56, wherein the tabs, 58, have filled in the holes of the outer part, 54. Once the SMP or SMP composite is cooled, FIG. 4B shows how the distance between the first end point, 64, and second end point, 66, of the tab, 58, is now larger than the distance between the third end point, 62, and fourth end point, 60, of the hole such that the SMP or SMP composite prevents the outer part, 54, from moving.

Figure 5:
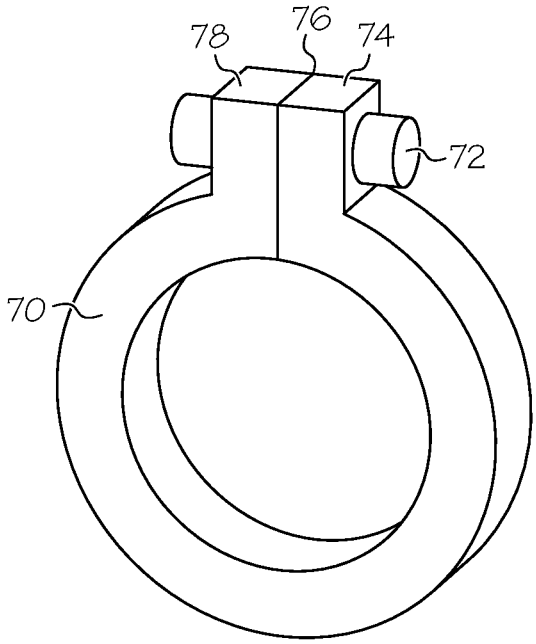
FIG. 5 shows a perspective view of another mechanism for using shape memory polymer and a clamp to seal a container.
Figure 6:
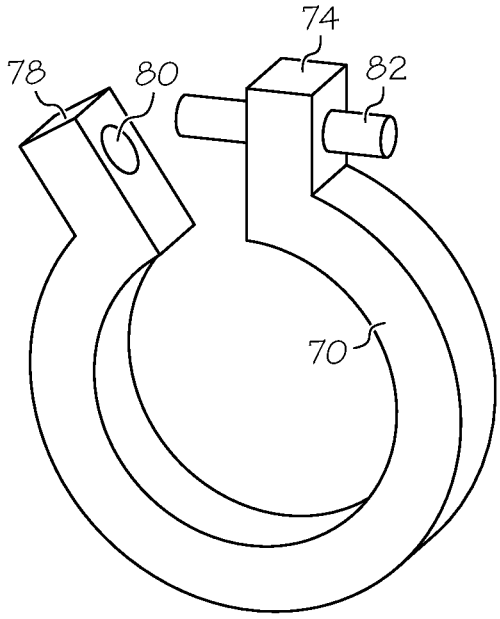
FIG. 6 shows a perspective view of how the third embodiment will vent a container by allowing the clamp to come undone.

A third embodiment is shown in FIGS. 5 and 6. In FIG. 5 a clamp, 70, is held together by a piece of SMP or SMP composite, 72. The clamp, 70, has a first end piece, 78, and a second end piece, 74, which are held closely together at a joint, 76, by the SMP or SMP composite, 72. As shown in FIG. 6, this is accomplished by the SMP or SMP composite, 72, as shown in FIG. 5, having a larger diameter than the hole, 80, as shown in FIG. 6, through which the SMP or SMP composite passes. When the SMP or SMP composite is reduced in size, 82, as shown in FIG. 6, the first end piece, 78, and second end piece, 74, are no longer held together and come apart, releasing the contents of the container.

Figure 7:
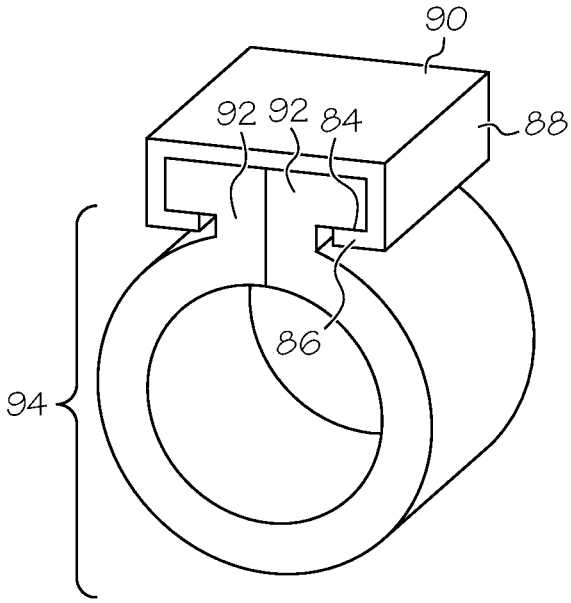
FIG. 7 shows a perspective view of a fourth embodiment of how shape memory polymer and a clamp can be used to seal a container.
Figure 8:
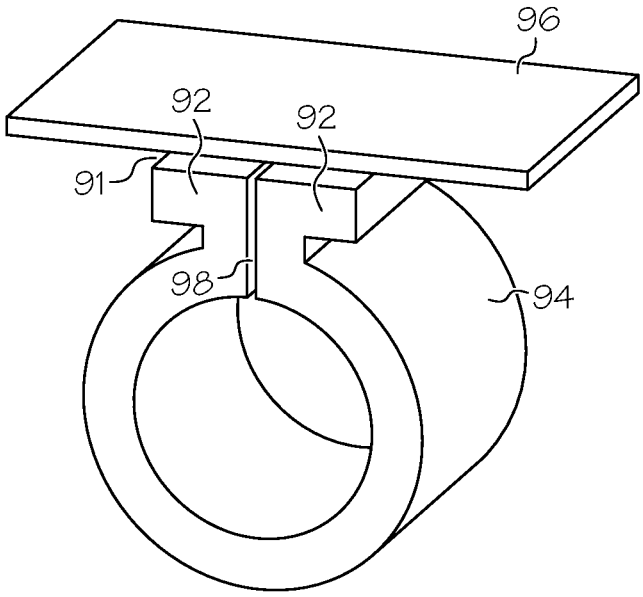
FIG. 8 shows a perspective view of how the shape memory polymer can be used to unseal the clamp in the fourth embodiment.

A fourth embodiment is shown in FIGS. 7 and 8. In this embodiment a SMP or SMP composite plate, 90, as shown in FIG. 7, is formed over the end pieces, 92, of a clamp, 94, creating a lip, 86, of SMP or SMP composite against a second lip, 84, of the end pieces, 92, and a side, 88, of SMP or SMP composite on both end pieces, 92, so as to hold the end pieces, 92, together. As shown in FIG. 8, when the SMP or SMP composite plate, 96, returns to its memory shape the end pieces, 92, are free to separate creating the gap, 98, between them and forcing the SMP or SMP composite plate, 96 to create a gap, 91, between the clamp, 94, and the SMP or SMP composite plate, 96. This loosening of the clamp and gaps allow the pressure within the container to vent.

Figure 9:
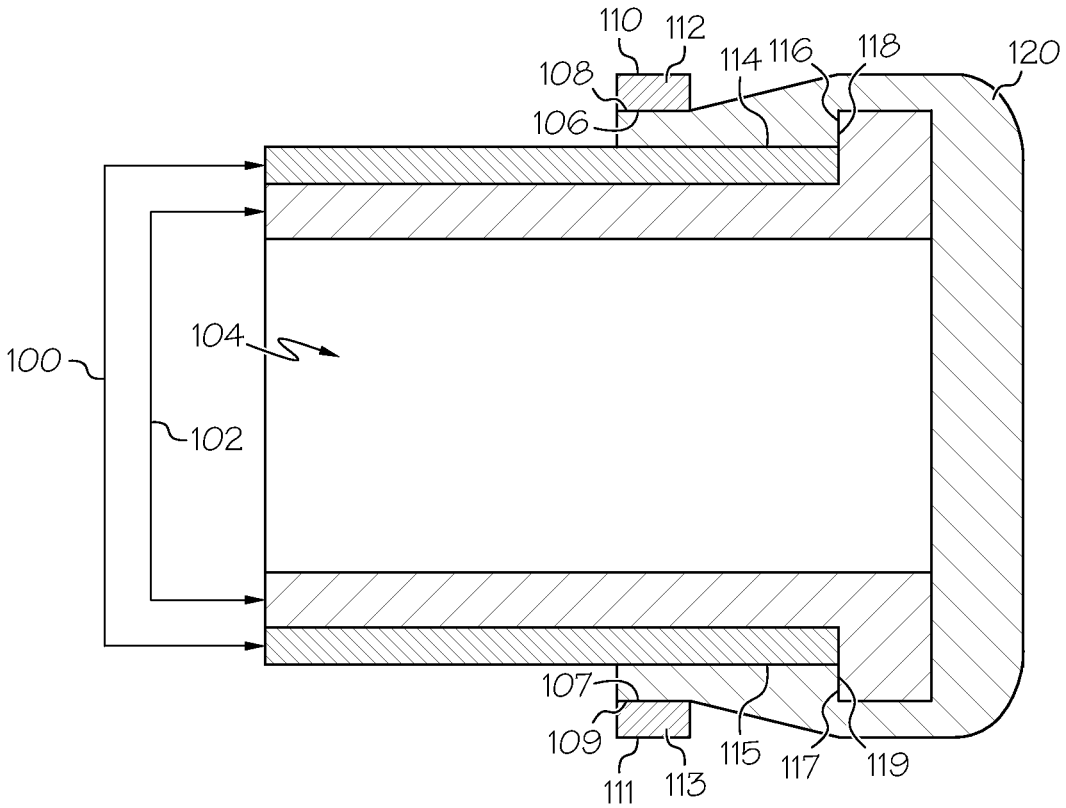
FIG. 9 shows a side view of a fifth embodiment of the use of shape memory polymer and a metal clamp to seal a container.
Figure 10:
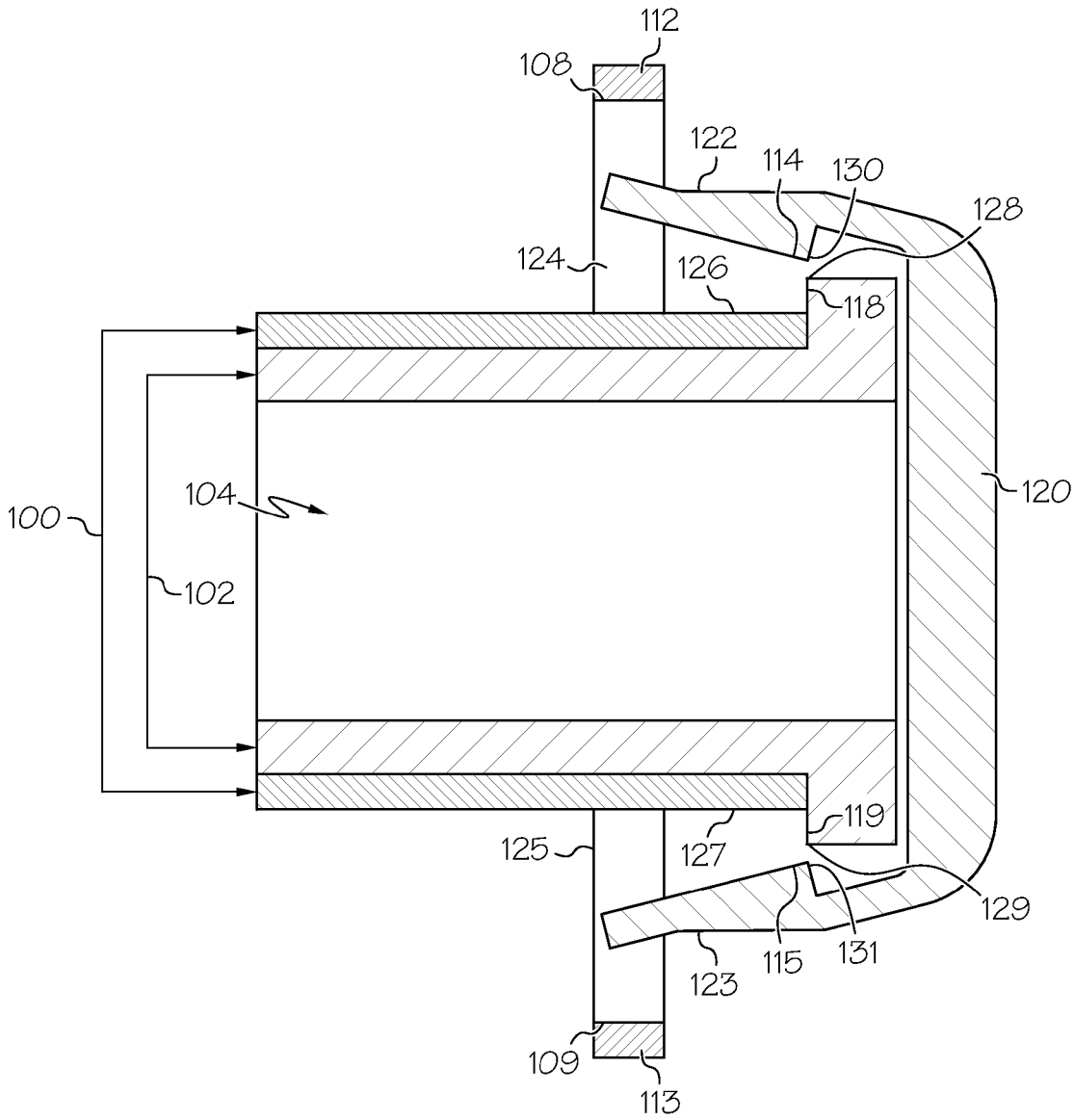
FIG. 10 shows a side view of how the shape memory polymer in the fifth embodiment will allow the venting of the container.

Another embodiment is shown in FIGS. 9 and 10. In FIG. 9, a band of SMP or SMP composite with an upper portion, 112, and a lower portion, 113, is wrapped around a metal clamp, 120, which holds an outer containment layer, 100, and an inner containment layer, 102, around a central core, 104. The upper portion, 112, has an inner surface, 108, which is pressed against the outer surface, 106, of the metal clamp, 120. A second inner surface, 114, of the metal clamp, 120, is pressed against the outer containment layer, 100, and the inner containment layer, 102, along a third inner surface, 116, and the outer surface, 118, of the inner containment layer, 102. The lower portion shown in FIG. 9, 113, works identical to the upper portion with an inner surface, 109, which is pressed against the outer surface, 107, of the metal clamp, 120. A second inner surface, 115, of the metal clamp, 120, is pressed against the outer containment layer, 100, and the inner containment layer, 102, along a third inner surface, 117, and the outer surface, 119, of the inner containment layer, 102. At normal operating temperatures, the tension of the SMP or SMP composite band, 112 and 113, keeps the surfaces, 114 and 115, and edges, 116 and 117, of the metal clamp, 120, in contact with the outer surface of the outer containment layer, 100, and the lips, 118 and 119, of the inner containment layer, 102, maintaining an environmental seal to protect the contents.

When the SMP's activation temperature is exceeded, the band, 112 and 113, actuates, returning to its expanded memory shape, as shown in FIG. 10. The SMP or SMP composite band will expand creating a larger portion of SMP or SMP composite, 124 and 125, all around the metal clamp, 120. The inner surfaces, 108 and 109, of the SMP or SMP composite band, 112 and 113, will retract from the outer surfaces, 122 and 123, of the metal clamp, 120. As the SMP or SMP composite bands retract, the metal clamp, 120, will be able to return to a normal, non-stressed state. In returning to this non-stressed state, the inner surfaces, 114 and 115, of the metal clamp, 120, will retract from the inner and outer containment layers, 100 and 102, so as to release the contents of the central core, 104. The metal clamp, 120, and SMP or SMP composite band, 112 and 113, must be designed so that after the SMP or SMP composite band has fully expanded, the metal clamp has sufficient room to expand so that the upper corner, 130, and lower corner, 131, of the metal clamp, have sufficient clearance room over the outer upper corner, 128, and outer lower corner, 129, of the inner containment layer, 102, so that the metal clamp will fall away from the central core, 104, to allow the inner core to vent. As before, the metal clamp is the primary structural element in the system, with the SMP composite band solely used to keep the metal latches in contact with the body of the container throughout normal operation.

Figure 11:
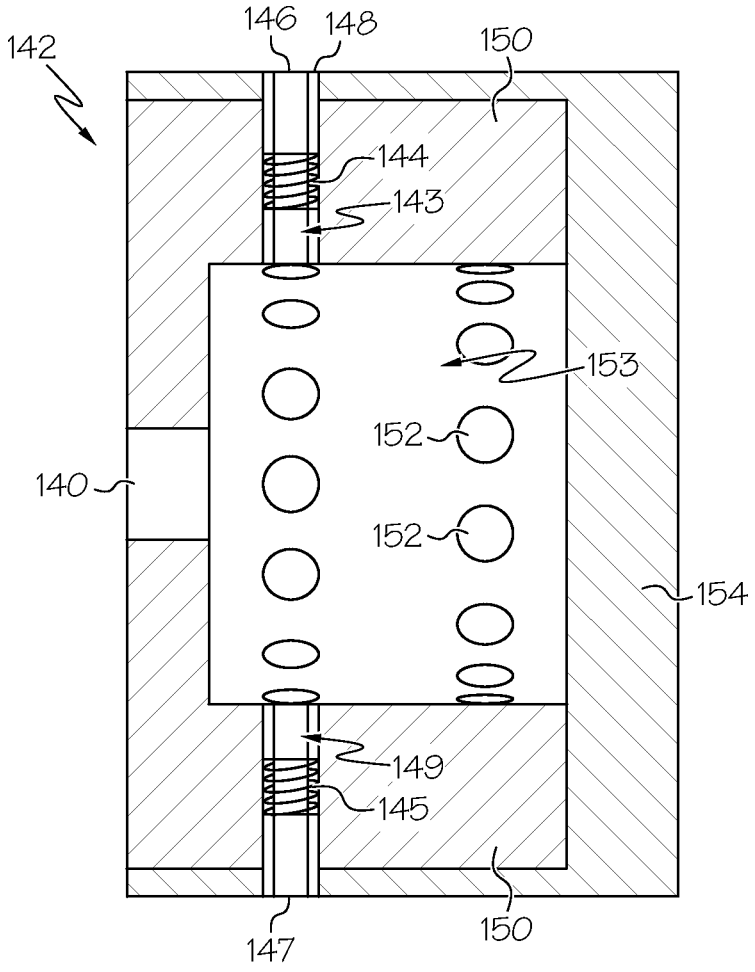
FIG. 11 shows a side view of the preferred embodiment of the use of shape memory polymer to seal a container.
Figure 12:
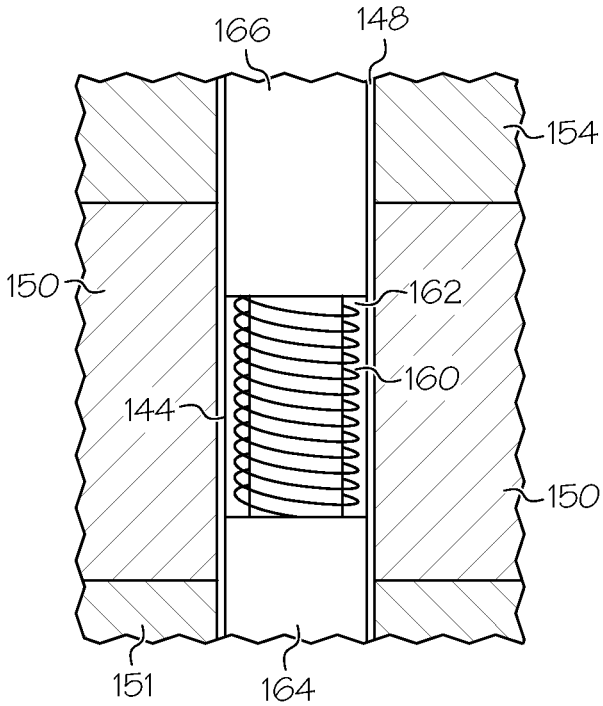
FIG. 12 shows a side view of a close up of the preferred embodiment.

In the final, preferred embodiment, a system of metal springs encased in SMP or SMP composite is used as shown in FIGS. 11 and 12. In FIG. 11. the existing aft closure design of IM currently used in the field is used and merely replaces the bolts used to attach the aft closure, 150, to the rocket motor case, 154, with retracting bolts, 143, 146, 147 and 149. The retracting bolts are attached to SMP or SMP composite encased springs, 144 and 145, which hold the retracting bolts within the holes, 152, in the holding ring, 153, located within the aft closure, 150. The rocket, 142, is attached to the aft closure, 150, by a connecting piece, 140.

FIG. 12 shows a close up of the locking both mechanism. The SMP or SMP Composite, 162, encases a high tension spring, 160. The SMP or SMP composite does not act on the upper retracting bolt, 166, or the lower retracting bolt, 164; the purpose of the SMP or SMP composite is to prevent the high tension spring, 160, from moving while the SMP or SMP composite is in its hard, rigid state. The inner holding ring, 151, aft closure, 150, and rocket motor case, 154, are merely shown for reference. The retracting bolts, 164 and 166, along with the SMP or SMP composite, 162, high tension spring, 160, are designed such that a small gap, 148, is left on either side of the retracting bolts so that the retracting bolts are not seized up by contact with the aft closure, inner holding ring, or rocket casing. The retracting bolt ends attach to the rocket casing and aft closure through existing threads and also attaches to the SMP or SMP Composite encapsulated spring. When an external thermal stimulus heats the SMP or SMP composite encapsulated spring, the spring retracts, releasing the aft closure from the case. Upon initial pressurization, the aft closure would be ejected from the aft end of the rocket motor, increasing the venting diameter by 700% with respect to the throat size on the aft closure.

In all of the disclosed embodiments these SMPs or SMP composites may have an integrated heating mechanism to provide for the manual venting of a container. Preferably the heating mechanism consists of wires embedded into the SMP or SMP composite, which provide resistance heating when a current is passed through them. As mentioned above, heating the SMP above its Tg will cause the SMP to become soft and pliable or return to its memory shape depending on the level of strain in the SMP prior to reaching its Tg; however, other methods are available for activating the SMP including light, UV radiation, other electromagnetic radiation, water, and magnetic fields. Application of these stimuli will also cause the SMP to transition between a soft pliable state to a hard rigid state depending on the chemistry used in the manufacture of the SMP resin. It will be apparent to one of skill in this art that there are many different ways, besides resistance heating, to heat the SMP or SMP composites, such as convective and radiation heating, which are hereby included within the scope of the present device.

In general, the preferred SMP is either a styrene copolymer based SMP as disclosed in U.S. Pat. No. 6,759,481, an epoxy based SMP as disclosed in PCT Application No. PCT/US2006/062179, and a cyanate ester based SMP as disclosed in PCT Application No. PCT/US2005/015685. However, other types of SMPs such as cyanate ester, polyurethane, polyethylene homopolymer, styrene-butadiene, polyisoprene, copolymers of stearyl acrylate and acrylic acid or methyl acrylate, norbornene or dimethaneoctahydronapthalene homopolymers or copolymers, malemide and other shape memory polymers are within the scope of the present device.

The SMP or SMP composite, as discussed above, may include a thermal energy generation means embedded therein. Such thermal energy generation means may comprise, for example, thermally conductive fibers or electrical conductors.

INDUSTRIAL APPLICABILITY

The lack of cheap, effective means for ensuring IM compliance has been known in the art. The disclosed device satisfies both the IM compliance requirements and does so in a cheap and effective manner.

However, the applicability of this device is not limited to IM or military uses. This device can be used to automatically vent any container of hazardous or explosive material when environmental conditions make the potential for damage or loss of life unacceptable. The oil and chemical industry, gas stations, refineries, storage facilities, and others can use this mechanism without a massive redesign or remodel of the current systems used. The ability to integrate this device into currently used systems will be apparent to those of skill in the art.

Although this device has been described with respect to certain preferred embodiments, it will be appreciated that a wide variety of equivalents may be substituted for those specific elements shown and described herein, all without departing from the spirit and scope of the invention as defined in the appended claims.

What is claimed is:

1. A venting device comprising:

a container comprising an opening;

an inner containment layer laterally disposed around the container and comprising at least outer lip disposed at an end proximate the container opening;

an outer containment layer laterally disposed on the inner containment layer but not disposed over the at least one outer lip;

a metal clamp configured to cover the opening and comprising at least one end flange, the end flange comprising an inner surface configured to contact an outer surface of the outer containment layer, and a recessed section configured to engage the outer lip of the inner containment layer; and an expandable shape memory band wrapped around the end flange of the metal clamp, the end flange being moveable with the expandable shape memory band, wherein the expandable shape memory band comprises a shape memory polymer or shape memory polymer composite that diametrically expands in size at a predetermined critical temperature, wherein the expansion of the expandable shape memory band upon reaching the predetermined critical temperature outwardly moves the end flange of the metal clamp, which separates the inner surface of the end flange from the outer surface of the outer containment layer and decouples the recessed section of the end flange from the outer lip of the inner containment layer, thereby detaching the metal clamp to vent the container.

2. The venting device of claim 1 wherein said shape memory polymer or said shape memory polymer composite used in the expandable shape memory band is selected from the group consisting essentially of styrene based, epoxy based, cyanate ester based, polyurethane based, maleimide based, or siloxane based shape memory polymer.

3. The venting device of claim 2 wherein said shape memory polymer is a thermoset resin.

4. The venting device of claim 1 wherein said shape memory polymer composite is formed from at least one layer of fibrous material in combination with said shape memory polymer.

5. The venting device of claim 4 wherein said fibrous material is embedded in said shape memory polymer.

6. The venting device of claim 4 wherein said fibrous material is impregnated with said shape memory polymer.

7. The venting device of claim 4 wherein said fibrous material is carbon nano-fibers, carbon fiber, spandex, chopped fiber, random fiber mat, fabric of any material, continuous fiber, fiberglass, or other type of textile fabric.

8. The venting device of claim 4 wherein said fibrous material is in the form of a flat weave, two dimensional weave, or three dimensional weave pattern.

* * * * *

UNITED STATES PATENT AND TRADEMARK OFFICE

CERTIFICATE OF CORRECTION

PATENT NO. : 8,668,110 B1
APPLICATION NO. : 13/718361
DATED : March 11, 2014
INVENTOR(S) : Traxler et al.

It is certified that error appears in the above-identified patent and that said Letters Patent is hereby corrected as shown below:

ON THE TITLE PAGE

Item 72 should read

Eric W. Traxler, Beavercreek, OH (US);
Jamie B. Vanderhorst, West Chester, OH (US);
David E. Havens, Bellbrook, OH (US);
Brandon C. Kirby, Beavercreek, OH (US);
Michael J. Fisher, Springboro, OH (US);
Joel J. Everhart, Beavercreek, OH (US);
Matthew C. Everhart, Fairborn, OH (US);
Kevin J. Heitkamp, Chicago, IL (US)

Signed and Sealed this
Third Day of May, 2016

Michelle K. Lee

Michelle K. Lee
*Director of the United States Patent and Trademark Office*